US005516221A

United States Patent [19]

Lake

[11] Patent Number: 5,516,221

[45] Date of Patent: May 14, 1996

[54] QUICK-ATTACHING EDGE TRIMMER FOR PIN-FEED PAPER SYSTEMS

[76] Inventor: Richard L. Lake, 717 Jacana Way, North Palm Beach, Fla. 33408

[21] Appl. No.: 161,709

[22] Filed: Dec. 3, 1993

[51] Int. Cl.[6] ..... B41J 11/26

[52] U.S. Cl. ..... 400/621.1; 83/423; 83/425.3; 400/616; 400/621; 225/99

[58] Field of Search ..... 400/616, 621, 400/621.1; 83/423, 425.3, 856, 425, 425.2; 225/99, 106, 96.5

[56] References Cited

U.S. PATENT DOCUMENTS

| | | | |
|---|---|---|---|
| 1,581,821 | 4/1926 | Waldheim | 400/621.1 |
| 2,311,051 | 2/1943 | Hope | 197/133 |
| 2,788,852 | 4/1957 | Sharpe | 164/39 |
| 3,056,324 | 10/1962 | Lach | 83/422 |
| 3,937,377 | 2/1976 | Schueler | 225/94 |
| 4,094,217 | 6/1978 | Exline | 83/6 |
| 4,423,975 | 1/1984 | Krenz | 400/616 |
| 4,572,686 | 2/1986 | Tanaka | 400/621.1 |
| 4,611,518 | 9/1986 | Hildebrandt | 83/105 |
| 4,831,909 | 5/1989 | Peters et al. | 83/425.4 |
| 4,940,347 | 7/1990 | Lund | 400/621.1 |
| 4,993,856 | 2/1991 | Chung | 400/621.1 |
| 5,036,739 | 8/1991 | Clar | 83/422 |
| 5,072,869 | 12/1991 | Padgett | 225/106 |
| 5,102,246 | 4/1992 | Patz | 400/621.1 |
| 5,120,144 | 6/1992 | Lund | 400/621.1 |
| 5,190,386 | 3/1993 | Eudy | 400/621.1 |
| 5,259,543 | 11/1993 | Downing | 225/99 |

FOREIGN PATENT DOCUMENTS

| | | | |
|---|---|---|---|
| 319998 | 12/1982 | Germany | 400/621.1 |
| 0224771 | 12/1983 | Japan | 400/621.1 |
| 0162071 | 9/1984 | Japan | 400/621.1 |

*Primary Examiner*—Edgar S. Burr
*Assistant Examiner*—Lynn D. Hendrickson
*Attorney, Agent, or Firm*—Quarles & Brady

[57] ABSTRACT

A paper edge trimmer for a printer using pin-feed paper with holed edges has a edge trimmer body that fits on a support member in close proximity to a feed roller. In several embodiments, the body has two opposing portions joined by an integral hinge and separated by a split to permit the body to be pinched apart and installed on a support rod. Several alternative embodiments are shown for securing the body to the printer. The cutting edge extends down through the score line of the paper to separate the holed edge portions from a main portion on which matter is printed.

17 Claims, 6 Drawing Sheets

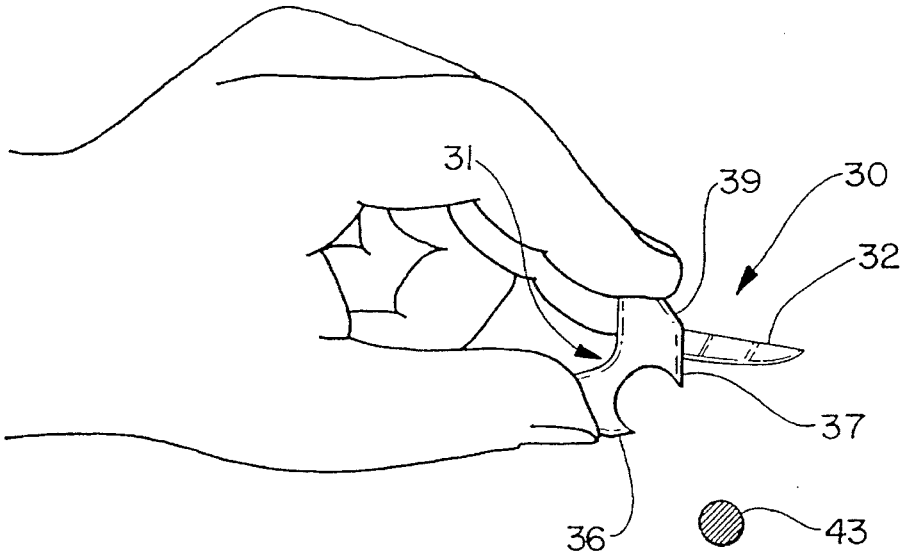
FIG. 1A
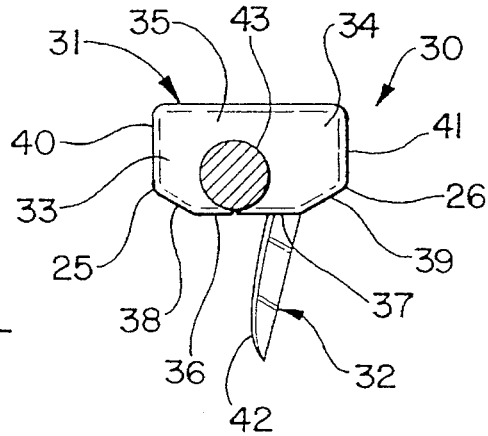
FIG. 1B
FIG. 2
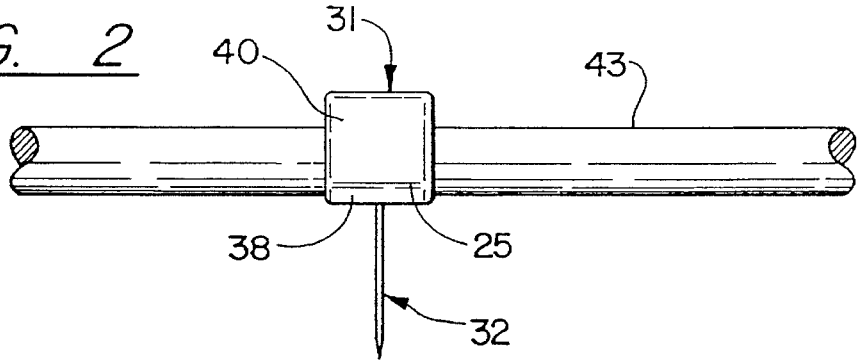
FIG. 3
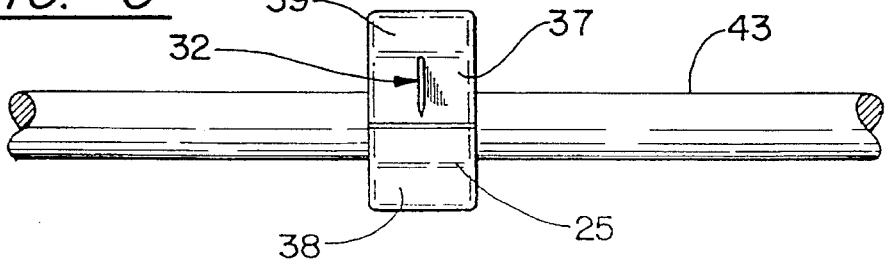

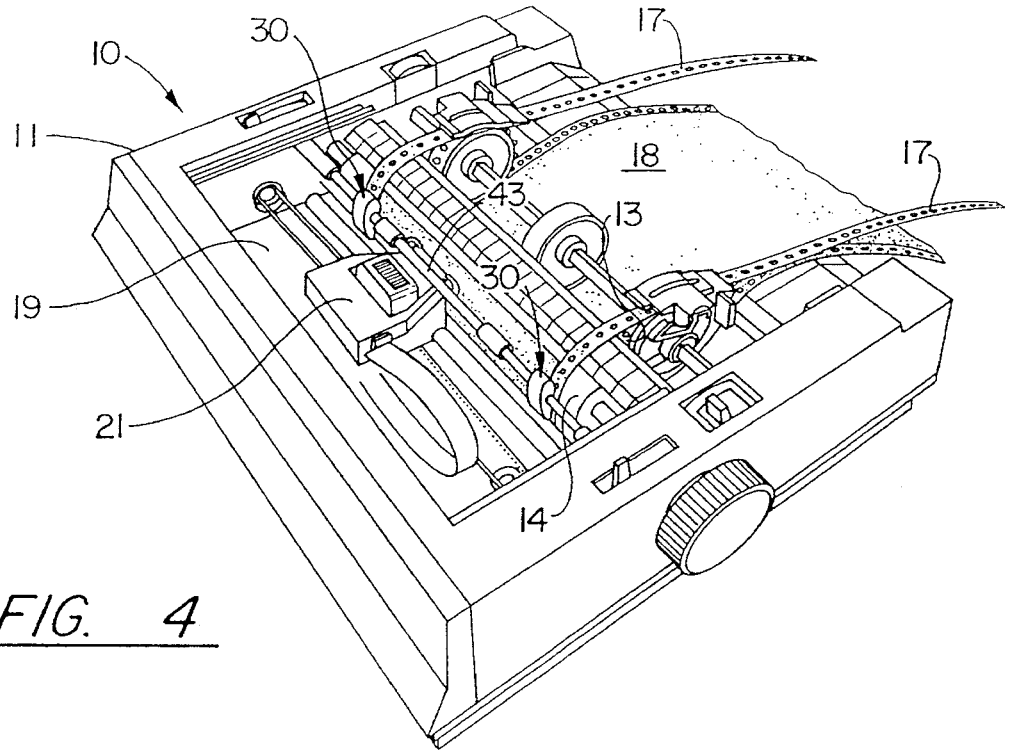
FIG. 4
FIG. 5
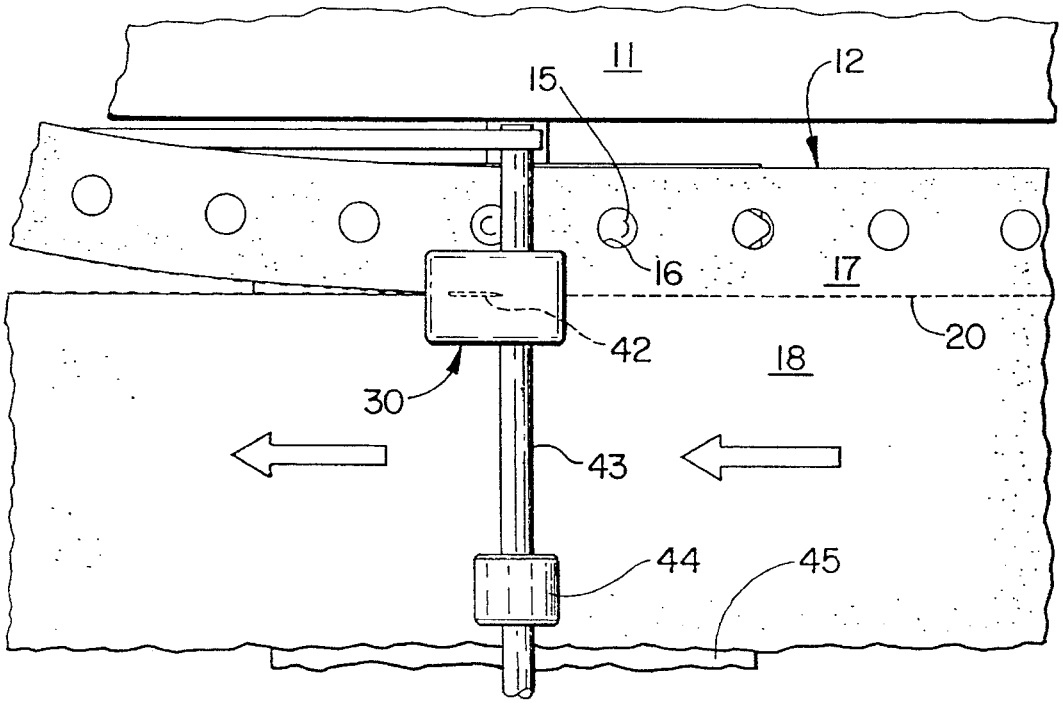

QUICK-ATTACHING EDGE TRIMMER FOR PIN-FEED PAPER SYSTEMS

TECHNICAL FIELD

The invention relates to edge trimming devices for pin-feed paper feeding systems of the type seen in computer printers.

BACKGROUND ART

One type of paper commonly handled by computer printers has a web of many sheets joined end to end and joined along the sides with holed edge portions. This web is fed through the printer with the help of a pin-feed system, is printed on, and then must be separated into individual sheets. The holed edge portions of each sheet are separated from the main body by score lines or perforated lines, so that the holed edge portions can be separated from the printed area along these lines. The holed edge portions are usually, but not always, removed by hand. When one page or many pages are printed in one job, the tearing and stripping of the edge portions from the paper can be a laborious task. The side edges must also be removed from the last printed sheet, which typically requires the advancement of the paper roll to permit proper gripping. An unprinted sheet, however, must usually be advanced past the printing area to permit this process, which then requires either the back-rolling of the paper or the waste of an unprinted sheet.

It would be advantageous to provide some means of automatically stripping the holed edge portions of the paper before the paper reaches the printing area, or at the printing area.

Eudy, U.S. Pat. No. 5,190,386, and Lund, U.S. Pat. No. 5,120,144 show printers with edge strip trimmers mounted on the tractor feed clips, past the printing area, used in many printers to hold the paper on the tractor feed sprocket wheels. Chung, U.S. Pat. No. 4,993,856, shows another type of edge strip trimmer mounted on the base for the tractor feed sprocket.

Generally, the prior art has provided edge strip trimmers that are relatively complex and difficult for a user to attach, or are specially adapted to a particular machine. There is the further problem of replacing blades in these devices. Also, these prior art devices mount the strip trimmers past the printing area, and therefore still require back-rolling of the paper, or the waste of a sheet of paper, in order to remove a printed sheet that has been completely trimmed.

There is a need in the art for an inexpensive, easy-to-install and remove edge strip trimmer, mountable on a variety of printers and tractor feed systems.

SUMMARY OF THE INVENTION

The invention provides an edge strip trimmer for a variety of printers using continuous computer paper. The edge trimmer is easy to install and remove. It is also low in manufacturing cost and cost to the customer, so that it may be a disposable item, thereby solving the problem of periodic replacement of blades.

In contrast to prior devices that are mounted as part of the pin-feed sprocket pull mechanism, the edge trimmer of the present invention is installed either on a paper bail rod or close to or immediately before or after the platen roller. The edge trimmer can be installed on a paper bail rod, on a platen cover which rests just over the platen roller on the push tractor feed, or on similar structure located at or near the printing area.

The edge trimmer includes 1) an edge trimmer body supported on a member that is positioned close to and substantially parallel to a paper feed roller, 2) a cutting edge fixed to the edge trimmer body, and 3) means for removably securing the edge trimmer body to the member with the cutting edge in cutting position along one of the separation lines to separate the holed edge portion of the paper from the main portion. The cutting edge can be formed with or connected to the edge trimmer body, and alternatively can be provided on a member, such as a blade, that is connected to the edge trimmer body.

The invention provides several embodiments which attach to the paper bail rod, and which include an edge trimmer body with two opposing body portions that can be opened to a spread position and slipped onto a paper bail rod, each body portion having an inner face contacting the rod when the edge trimmer body is secured to the rod.

Various types of securing systems can be used including a hinged body with a lock tab and notch, a body with a pair of stab fasteners and a body with a tie strip and a detent for gripping a free end of the tie after it is wrapped around a support rod.

The invention also provides alternative embodiments for printers not having a paper bail which can be formed as a paper edge guide fastened to a printer cover or another part of the printer.

The body of the edge trimmer may be made inexpensively of materials such as plastic, rubber or metal.

Other objects and advantages, besides those discussed above, will be apparent to those of ordinary skill in the art from the description of the preferred embodiments which follow. In the description, reference is made to the accompanying drawings, which form a part hereof, and which illustrate examples of the invention. Such examples, however, are not exhaustive of the various embodiments of the invention and, therefore, reference is made to the claims which follow the description for determining the scope of the invention.

BRIEF DESCRIPTION OF THE DRAWINGS

FIG. 1A is a right side view, partially in cross section, of a first embodiment of the edge trimmer of the present invention being installed for use;

FIG. 1B is a right side view, partially in cross section, of the first embodiment of the edge trimmer of the present invention after installation;

FIG. 2 is a top plan view of the edge trimmer of FIG. 1;

FIG. 3 is a front view of the edge trimmer of FIG. 1;

FIG. 4 is a perspective view of one example of a printer in which the invention is used; and FIG. 5 is a top detail view of a printer having the edge trimmer of FIGS. 1–3 installed thereon;

DETAILED DESCRIPTION OF THE PREFERRED EMBODIMENT

Figure 6A:
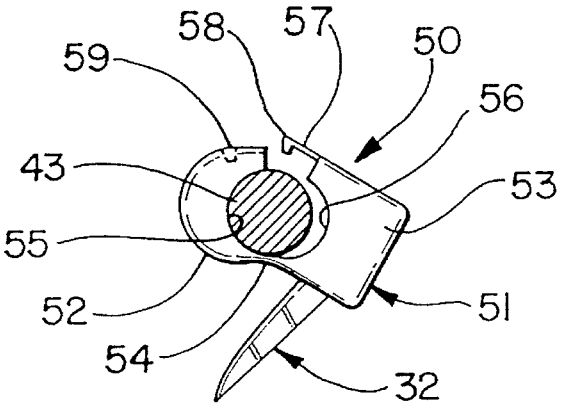
FIG. 6A is a right side view, partially in cross section, of a second embodiment of an edge trimmer according to the present invention in an open position.

FIGS. 1A–B, 2, and 3 show a first embodiment of an edge trimmer 30 of the present invention, which is applicable to a printer 10 having a tractor feed mechanism as seen in FIG. 4.

The trimmer 30 includes a body 31 and a knife blade 32. The body 31 is snapped on and off a support rod 43, which may be a paper bail rod 43 in a printer 10 as shown in FIG. 4. The rod 43 runs substantially transverse to a paper feed path shown by an arrow in FIG. 5. The body has opposing portions 33, 34, as shown in FIG. 1B, which are connected by an integral hinge portion 35, and which are split apart to allow the body 31 to be installed on the rod 43 as illustrated in FIG. 1A. The body 31 has faces 38, 39 extending from faces 36, 37 to side faces 40, 41 of the body 31. The oblique faces 38, 39 provide corners 25, 26 which allow for gripping and handling the body 31 as illustrated in FIG. 1A. The knife blade 32 extends downward from the top toward the rear of the body with the cutting edge 42 facing forward to engage the paper 12 (FIG. 5). Preferably, the knife blade 32 is provided with a guard (not shown), which is removed after installation of the trimmer 30 on rod 43.

The printer 10 in FIG. 4 includes a housing 11 with a large paper-feeding cavity 19. A web of paper 12 seen in FIG. 5 is fed through a slot (not seen) in the rear of the housing 11, passes below sprocket wheels 13 and is wrapped around platen roller 14. The web 12 is then fed back to the top of sprocket wheels 13, where pins 15 on the sprocket wheels 13 are received in holes 16 (FIG. 5) in edge portions 17 of the web 12. The holed edge portions 17 are defined by score lines 20 which run parallel to the edges of the web 12 and separate the edge portions 17 from a main portion 18 on which matter is printed by the print head 21.

The trimmer 30 of FIGS. 1A and 1B is conveniently installed on a paper bail rod 43 (FIG. 5), which is supported by a small roller 44 on feed roller 45 mounted on a common axis of rotation with the sprocket wheels 13. As used herein, the term "feed roller" applies to both roller 45 and platen roller 14. The cutting edge 42 of the knife blade 32 is aligned with the score line 20 on one side of the paper 12. The knife blade 32 is long enough to extend through the paper 12 in a space next to the sprocket wheel 13. It should be apparent that it is preferable to use two of the trimmers 30 to separate the holed edge portions 17 on opposite sides of the paper 12. To conserve space in the illustration, only one of the trimmers 30 has been shown in FIG. 5. The web 12 is fed into contact with the cutting edge 42 which then separates the holed edge portion 17 from the main portion 18 of the paper 12.

Figure 6B:
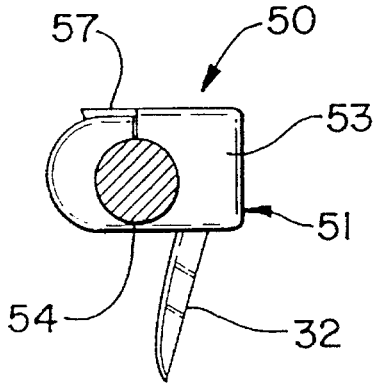
FIG. 6B is a right side view, partially in cross section, of the embodiment of FIG. 6A in a closed position.

Referring next to FIGS. 6A and 6B, a second embodiment 50 is shown with body 51 having opposing body portions 52, 53, and integral hinge portion 54 extending beneath the rod 43. The body portions 52, 53 have opposing, concave inside faces 55, 56 internal to the body 51 that fit closely onto the rod 43. A locking tab 57 on top of body portion 53 has a barbed end 58 that is received in notch 59 formed in the top of opposite body portion 52 to hold the body portions 52, 53 together as seen in FIG. 6B.

Figure 7:
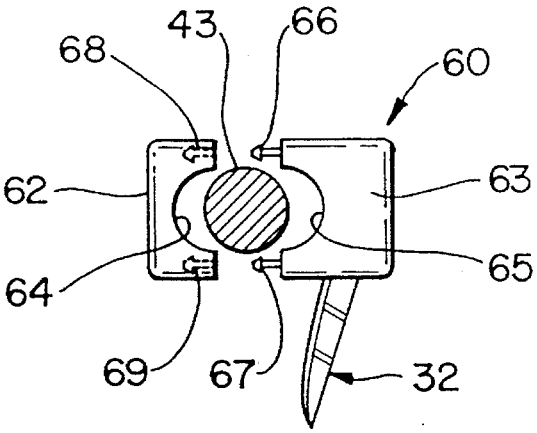
FIG. 7 is a right side view of a third embodiment of an edge trimmer according to the present invention in an open position.

In FIG. 7, a third embodiment 60 is shown with a body including opposing, separate body portions 62, 63 having concave inside faces 64, 65, which fit closely around the rod 43. Body portion 63 has two barb-ended stab connectors 66, 67 that are inserted and retained in two locking holes 68, 69 in the opposing body portion 62 to hold the opposing portions securely together on the rod 43. The connectors 66, 67 pass over and under the support rod 43.

Figure 8:
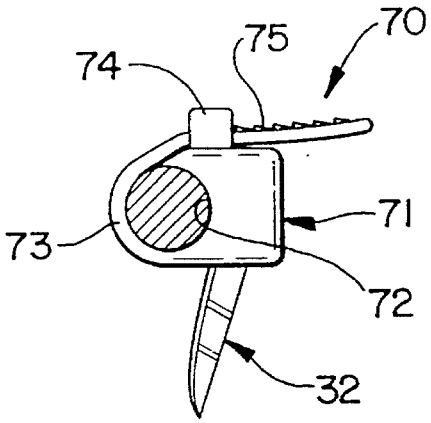
FIG. 8 is a right side view, partially in cross section, of a fourth embodiment of an edge trimmer according to the present invention in a closed position.

Referring to FIG. 8, a fourth embodiment 70 is shown with a body 71 forming one concave inside face 72 and with a flexible tie strip 73 wrapping around rod 43 from the bottom to the top and then extending through a lug 74 on the top of body 71. The tie strip 73 is formed with non-reversing transverse ridges 75 that act as a ratchet as the strip 73 is inserted through an aperture (not shown) in the lug 74 and pulled tight. The lug 74 acts as detent and holds the strip 73 by one of the non-reversing ridges 75.

The embodiments of FIGS. 1–8 are made of a flexible plastic material or of a foam material which is flexible when in a thin sheet or strip, but relatively firm when formed in a block. This allows the operation of the integral hinge as described above.

Figure 9A:
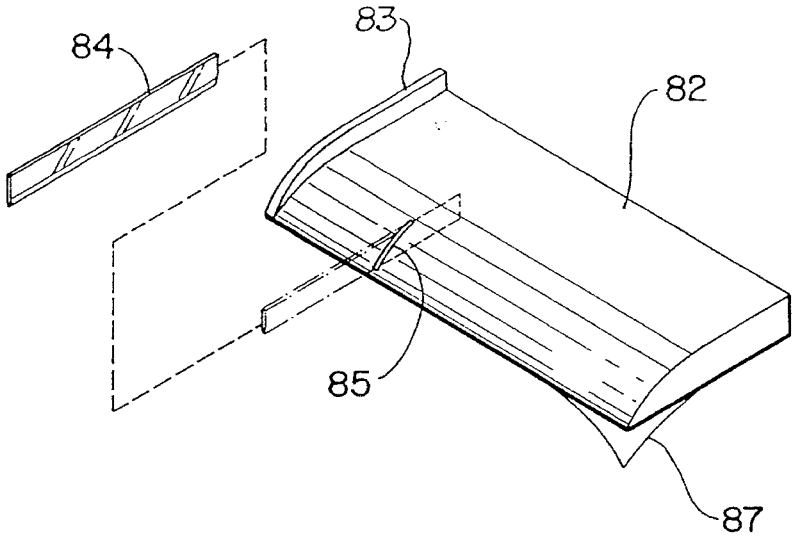
FIG. 9A is an exploded perspective view, partially in phantom, of a fifth embodiment of the present invention showing replacement of a blade and the removal of a protective covering over an adhesive strip.
Figure 9B:
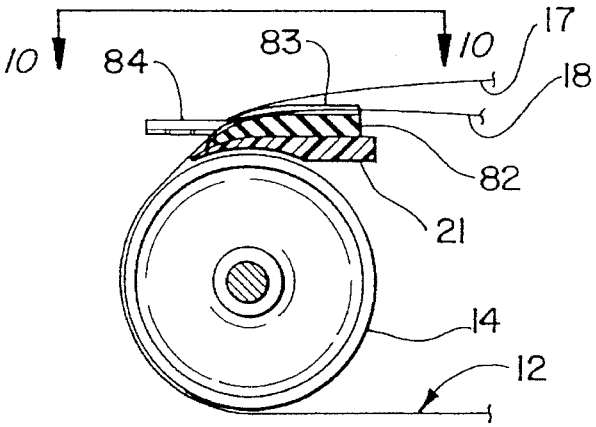
FIG. 9B is a right side view, partially in cross section, of a fifth embodiment of the invention as installed.
Figure 10:
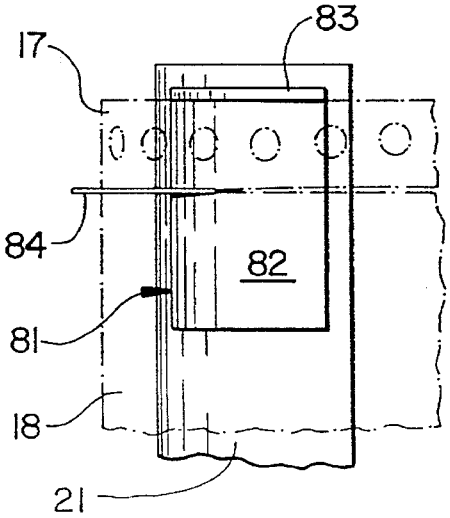
FIG. 10 is top view, partially in phantom, of the embodiment of FIG. 9.

Referring next to FIGS. 9A, 9B, and 10, a fifth embodiment 80 is shown in which the support for edge trimmer 80 is provided by a cover member 21 that fits over the platen roller 14. An edge trimmer body 81 is formed as an edge guide for the paper having a wing-shaped bottom portion 82 over which the paper 12 is fed and a side rail portion 83 that restricts movement of the paper 12 in a direction transverse to the feed path. The knife blade 84 with a cutting edge fits in a slot 85 (FIG. 9A) in the bottom portion 82 of the edge guide. The knife blade 84 extends outward from the nip of the platen roller 14 to intersect the feed path as the paper 12 is fed around the platen roller 14 and over the edge guide 81. The edge trimmer body 81 can be secured to the cover 21 by any suitable fastener, such as adhesive, which can be protected prior to installation by a removable covering 87. The edge trimmer body 81 can also be secured by a Velcro fastener system which facilitates the removal of the edge trimmer body 81. The blade 84 has a tight fit in slot 85, but can be removed by hand for replacement with a new blade 84. Hard plastic is a preferred material for this edge trimmer body 81.

The invention is provided on the printer such that the blade cuts the paper at or near the printing area, which is the area where the printing head applies the print to the paper. In a preferred embodiment, the blade is positioned approximately at the printing area. It is also possible to position edge trimmers according to the invention before or after the immediate printing area. Most preferably, the cutting edge of the trimmers should be located along the paper path no more than about four inches before the printing area, to about two inches after the printing area.

Figure 11:
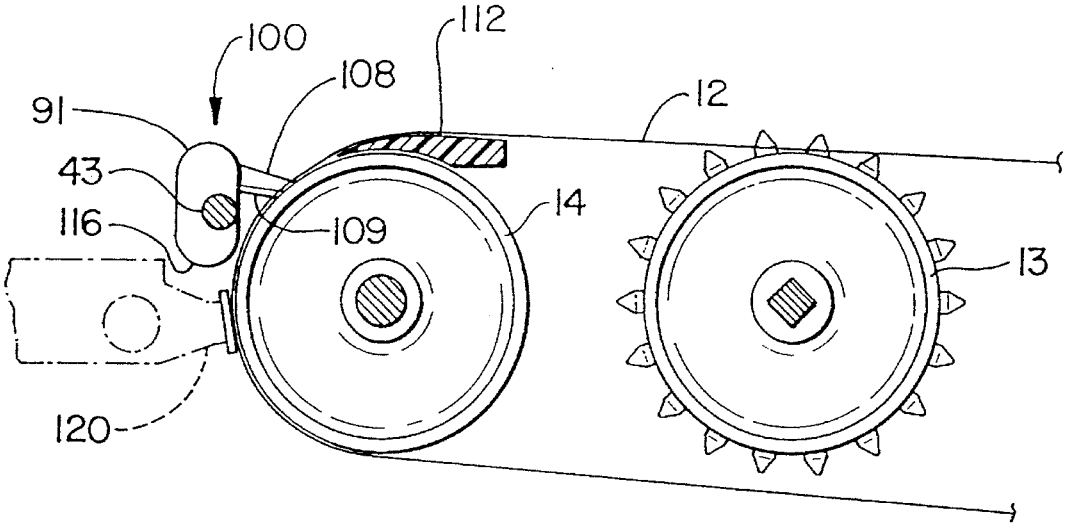
FIG. 11 is a side view of a sixth embodiment of the invention, partially in cross section and partially in phantom.

A preferred placement of a sixth embodiment of the invention is shown in FIG. 11. The trimmer 100 is preferably positioned on a support rod 43 in such a manner than the point of the blade 108, with a cutting edge 109, extends through the paper 12 and between the platen roller 14 and the platen cover 112. This orientation will secure the blade 108 in place and prevent unwanted movement during use, particularly for "push" type tractor printers. The bottom 116 of the trimmer 100 is truncated such that the printing head 120 can move from side to side without disturbance by the trimmers 100. The printing head 120 indicates the location of the printing area 121.

Figure 12:
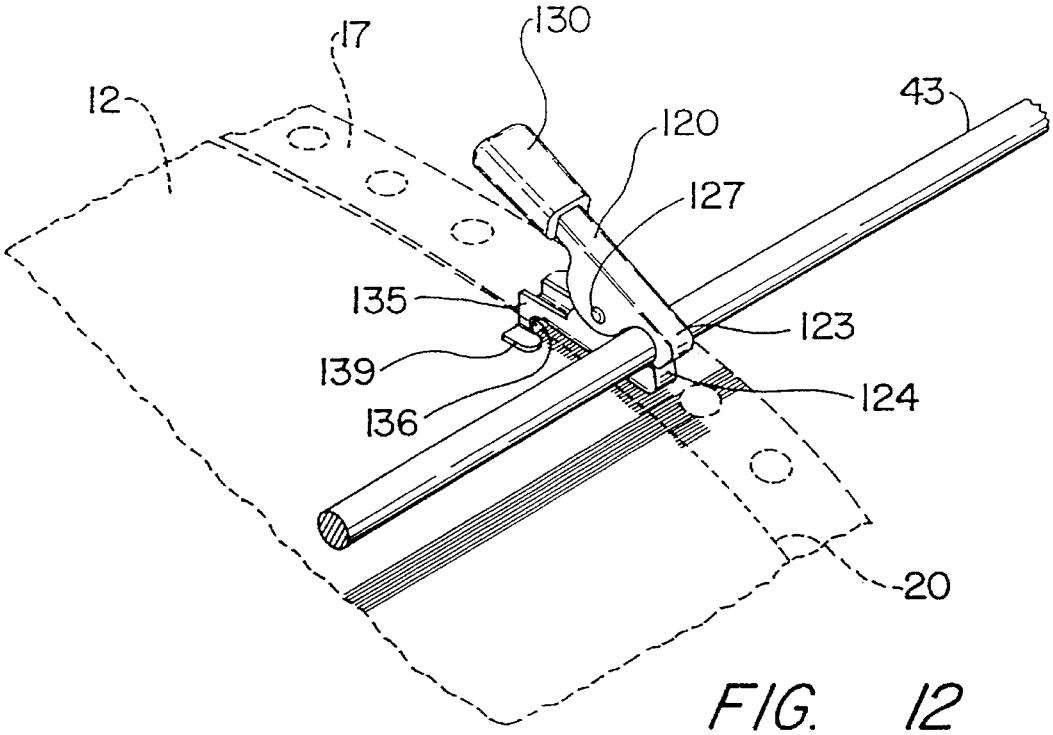
FIG. 12 is a perspective view, partially in phantom, of a seventh embodiment of the invention, as installed.

A seventh alternative embodiment of the invention is FIG. 12. A trimmer 130 according to the invention is generally in the form of a clamp with jaws 123, 124 pivotally mounted about a pivot pin 127 and biased by a spring (not shown). A handle 130 is provided for manipulating the jaws 123, 124 so as to attach the trimmer 130 to the support rod 43. The lower jaw 124 of the trimmer 130 includes a depending portion 135 which includes a forward-facing cutting edge 136. A support portion 139 can be formed at a lower end of the depending portion 135 and is preferably generally at right angles to the depending portion 135 so as to support and guide the paper 12 past the edge 136. The trimmer 130 is positioned on the support rod 43 in such a manner as to align with the score lines 20 of the paper 12. The edge 136 will sever the score lines 20 to separate the edge portion 17 as the paper is moved past the trimmer 130.

Figure 13:
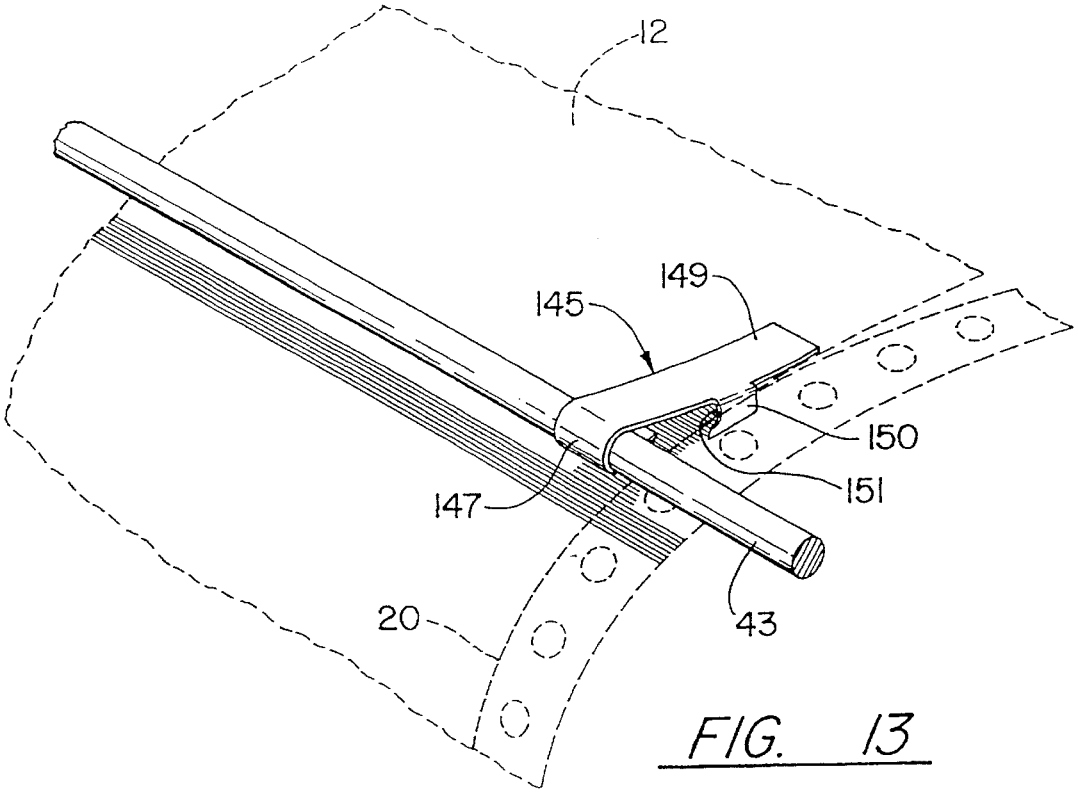
FIG. 13 is a perspective view, partially in phantom, of a eighth embodiment of the invention, as installed.

An eighth alternative embodiment is shown in FIG. 13. A trimmer 145 includes a curved, substantially C-shaped spring clamp portion 147 adapted to be forced onto and secured to the support rod 43. A body portion 149 extends rearwardly from the clamp portion 147. A downwardly depending blade portion 150 includes a cutting edge 151 formed at a leading edge thereof. The blade portion 150 is positioned at the score lines 20 of the paper 12 to separate the side edge portion 17.

Figure 14:
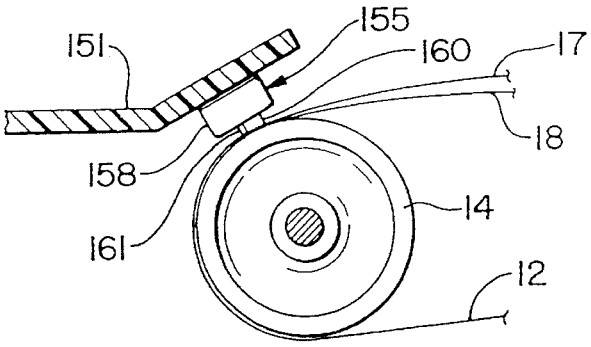
FIG. 14 is a side elevation, partially in cross section, of a ninth embodiment of the invention, as installed.

A ninth alternative embodiment of the invention is shown in FIG. 14. The printer 10 in this embodiment includes a dust cover 153, part of which extends over the platen roller 14. A trimmer 155 has a main body portion 158 which is adapted to be secured to a bottom face 152 of the dust cover 153, such as by an adhesive. A blade 160 with a cutting edge 161 extends downwardly from the main body portion 158, and into the paper 12, at the score lines 20. The movement of the paper past the blade 160 separates the paper into a main portion 18 and edge portions 17.

Figure 15:
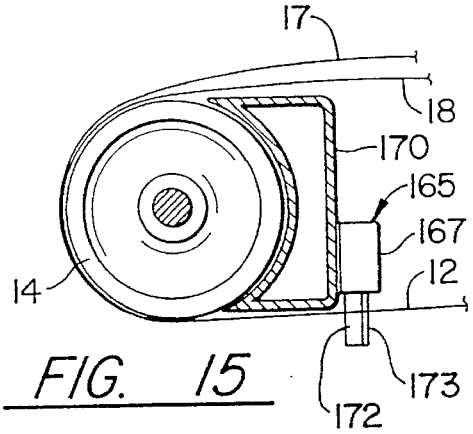
FIG. 15 is a side elevation, partially in cross section, of a tenth embodiment of the invention, as installed.

A tenth embodiment of the invention is shown in FIG. 15. A trimmer 165 includes a main body portion 167 that is secured to a support 170 of the printer 10 behind the platen roller 14. A blade 172 with a cutting edge 173 extends downwardly from the main body portion 167 and into paper 12. The blade 172 separates the paper 12 into a side edge portion 17 and main portion 18 before the paper reaches the platen roller 14 and printing area.

Figure 16:
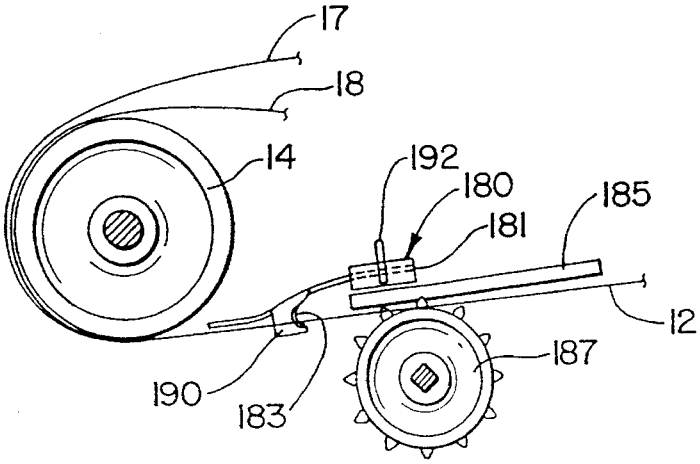
FIG. 16 is a side elevation, partially in cross section, of a eleventh embodiment of the invention, as installed.

An eleventh embodiment of the invention is shown in FIG. 16. In this embodiment, a trimmer 180 having a main body portion 181 is positioned behind the platen roller 14. A suitable attachment structure such as an adhesive is used to secure the main body portion to a support 185 of the printer, such as immediately above the sprocket wheel 187. A forward portion 190 extends forwardly from the main body portion 181. A pin 192 or other suitable structure can be utilized to secure the forward portion 190 to the main body portion 181, preferably in a manner which will permit pivoting of the forward portion 190 out of the cutting position. A blade 194 includes a cutting edge 193 that is positioned in the perforations of the paper 12 so as to separate the paper 12 into edge portion 17 and main portion 18 prior to reaching the platen 14 and printing area.

This has been a description of examples of how the invention can be carried out. Those of ordinary skill in the art will recognize that various details may be modified in arriving at other detailed embodiments, and these embodiments will come within the scope of the invention.

Therefore, to apprise the public of the scope of the invention and the embodiments covered by the invention, the following claims are made.

I claim:

1. An edge trimmer for a computer printer having a platen, a pin-feed sprocket to feed a web of paper along a feed path, the web of paper having a main portion and holed edge portions separable from the main portion along lines running on opposite sides of the main portion, and a member that is positioned close to and substantially parallel to the platen, the edge trimmer comprising:

an edge trimmer body having a stationary blade fixed to the edge trimmer body, such that when said edge trimmer body is secured in a cutting position, said blade will intersect the feed path of the paper in alignment with one of the lines on the paper to separate the holed edge portion of the paper from the main portion as the paper is fed into engagement with said blade; and clip-on structure for removably securing the edge trimmer body to the member with said blade in a cutting position aligned along one of the lines on the paper to separate the holed edge portion of the paper from the main portion.

2. The means for removably securing the edge trimmer of claim 1, wherein the edge trimmer body has opposing portions that are connected by an integral hinge.

3. The edge trimmer of claim 1, wherein:

the member close to the platen is a paper bail rod;

wherein the edge trimmer body has opposing body portions for wrapping around the paper bail rod, each body portion having a concave inside face contacting the rod when the edge trimmer body is secured to the rod; and wherein the securing means includes means on the opposing portions for securing the portions together.

4. The edge trimmer of claim 3, wherein the edge trimmer body is formed of plastic material.

5. The edge trimmer of claim 3, wherein the edge trimmer body is formed of a foam material.

6. The edge trimmer of claim 1, wherein said trimmer is positioned no more than about four inches before the printing area; to about two inches past the printing area.

7. The edge trimmer of claim 1, wherein said edge trimmer body has a portion adapted for mounting to the support rod of a printer, and the bottom portion is truncated so as to permit the passage of a printing head.

8. The edge trimmer of claim 1, wherein said machine comprises a dust cover having a bottom surface, and said trimmer body comprises a fastener for engaging the bottom surface of said dust cover, said cutting edge being provided on a blade depending from said trimmer body.

9. The edge trimmer of claim 1, wherein said trimmer body includes structure for mounting said trimmer body at a portion of the printer such that the cutting edge of the trimmer cuts the paper before the printing area.

10. An edge trimmer according to claim 1, further comprising a substantially planar paper support body formed perpendicular to said blade and parallel to said edge trimmer body to guide the paper as the holed edge portion of the paper is separated from the main portion.

11. An edge trimmer for a printer having a feed roller, having a pin-feed sprocket to feed a web of paper along a feed path, the web of paper having a main portion and holed edge portions separable from the main portion on lines running along opposite sides of the main portion, and the machine having a paper bail rod that is positioned close to and substantially parallel to the feed roller, the edge trimmer comprising:

an edge trimmer body having opposing body portions for wrapping around the paper bail rod, each body portion having a concave inside face contacting the rod when the edge trimmer body is secured to the rod;

a cutting edge fixed to the edge trimmer body, such that when the edge trimmer body is secured in a cutting position, the cutting edge will intersect the feed path of the paper in alignment with one of the lines on the paper to separate a holed edge portion of the paper from the main portion as the paper is fed into engagement with the cutting edge; and means for removably securing the edge trimmer body to the paper bail rod with the cutting edge in cutting position along one of the lines to separate the holed edge portion of the paper from the main portion, the securing means including means on the opposing portions for securing the portions together, the means for securing the opposing portions of the edge trimmer body including a barb-ended tab on one of the opposing portions which wraps around a portion of another one of the opposing portions, the other one of the opposing portions having a notch displaced from the first portion by a length of the tab, the notch receiving and holding the barb end of the tab to hold the opposing portions securely together on the rod.

12. An edge trimmer for a printer having a feed roller, having a pin-feed sprocket to feed a web of paper along a feed path, the web of paper having a main portion and holed edge portions separable from the main portion on lines running along opposite sides of the main portion, and the machine having a paper bail rod that is positioned close to and substantially parallel to the feed roller, the edge trimmer comprising:

an edge trimmer body having opposing body portions for wrapping around the paper bail rod, each body portion having a concave inside face contacting the rod when the edge trimmer body is secured to the rod;

a cutting edge fixed to the edge trimmer body, such that when the edge trimmer body is secured in a cutting position, the cutting edge will intersect the feed path of the paper in alignment with one of the lines on the paper to separate a holed edge portion of the paper from the main portion as the paper is fed into engagement with the cutting edge; and means for removably securing the edge trimmer body to the paper bail rod with the cutting edge in cutting position along one of the lines to separate the holed edge portion of the paper from the main portion, the securing means including means on the opposing portions for securing the portions together, the means for securing the opposing portion of the edge trimmer body including two barb-ended stab connectors on one of the opposing portions, the other one of the opposing portions having two locking holes for receiving the respective barb-ended stab connectors to hold the opposing portions securely together on the rod.

13. The edge trimmer of claim 12, wherein the two barb-ended stab connectors extend laterally above and below the rod, respectively, to reach the locking holes on the opposing portion of the body.

14. An edge trimmer for a printer having a feed roller, having a pin-feed sprocket to feed a web of paper along a feed path, the web of paper having a main portion and holed edge portions separable from the main portion on lines running along opposite sides of the main portion, and the machine having a paper bail rod that is positioned close to and substantially parallel to the feed roller, the edge trimmer comprising:

an edge trimmer body having opposing body portions for wrapping around the paper bail rod, each body portion having a concave inside face contacting the rod when the edge trimmer body is secured to the rod;

a cutting edge fixed to the edge trimmer body, such that when the edge trimmer body is secured in a cutting position, the cutting edge will intersect the feed path of the paper in alignment with one of the lines on the paper to separate a holed edge portion of the paper from the main portion as the paper is fed into engagement with the cutting edge; and means for removably securing the edge trimmer body to the paper bail rod with the cutting edge in cutting position along one of the lines to Separate the holed edge portion of the paper from the main portion, the securing means including means on the opposing portions for securing the portions together, one of the opposing portions of the edge trimmer body being a flexible tie strip, and wherein the means for securing includes detent means on another one of the opposing portions, the flexible tie strip wrapping around the rod and being inserted through the detent means to hold together the opposing portions of the edge trimmer body.

15. An edge trimmer for a computer printer having a platen, a pin-feed sprocket to feed a web of paper along a feed path, and a member that is positioned close to and substantially parallel to the platen, the web of paper having a main portion and holed edge portions separable from the main portion along lines running along opposite sides of the main portion, the edge trimmer comprising:

an edge trimmer body having a stationary cutting edge fixed to the edge trimmer body such that when the edge trimmer body is secured in a cutting position, the cutting edge will intersect the feed path of the paper in alignment with one of the lines on the paper to separate the holed edge portion of the paper from the main portion as the paper is fed into engagement with the cutting edge;

means for removably securing the edge trimmer body to the member with the cutting edge in a cutting position aligned along one of the lines on the paper to separate the holed edge portion of the paper from the main portion;

the member close to the platen roller being a top cover attached to the computer printer;

wherein the edge trimmer body is formed as an edge guide for the paper where the bottom portion over which the paper is fed, the bottom portion having a slot, and with a side rail portion that restricts movement of the paper in a direction transverse to the feed path; and wherein the cutting edge is provided on a blade that is removably secured in the slot in the bottom portion of the edge guide and extends outward from the platen roller to intersect the feed path as the paper is fed around the platen roller and over the edge guide.

16. An edge trimmer for a computer printer having a platen, a pin-feed sprocket to feed a web of paper along a feed path, and a member that is positioned close to and substantially parallel to the platen, the web of paper having a main portion and holed edge portions separable from the main portion along lines running along opposite sides of the main portion, the edge trimmer comprising:

an edge trimmer body having a stationary cutting edge fixed to the edge trimmer body, such that when the edge trimmer body is secured in a cutting position, the cutting edge will intersect the feed path of the paper in alignment with one of the lines on the paper to separate the holed edge portion of the paper from the main portion as the paper is fed into engagement with the cutting edge;

means for removably securing the edge trimmer body to the member with the cutting edge in a cutting position along one of the lines on the paper to separate the holed edge portion of the paper from the main portion;

wherein said trimmer comprises trimmer jaws pivotally mounted and biased toward one another, said trimmer jaws having an engagement surface adapted to grip the surface of a support rod, said cutting edge being provided on a portion extending downwardly from the lower jaws of said trimmer body.

17. An edge trimmer for a computer printer having a platen, a pin-feed sprocket to move a web of paper along a paper path, the web of paper having a main portion and holed lateral edge portions separable from the main portion along lines running on opposite sides of the main portion, the edge trimmer comprising:

an edge trimmer body having a substantially planar first portion, a curved portion extending from the first portion, and a second portion connected to said curved portion, said first portion, curved portion, and second portion forming a spring-clamp for engaging a portion of said computer printer;

a substantially planar paper-cutting blade substantially perpendicular to said first portion, said blade having side edges, a cutting edge being provided at one of said side edges, said blade being fixed to said first portion such that, upon connection to the printer, said planar blade portion will be substantially aligned with said line of said paper and with said cutting edge facing upstream to said feed path for separating said edge portion, said first portion extending at least in part laterally inwardly so as to contact said web of said paper to, with said planar blade portion, form a corner which will guide the web along said paper path.

* * * * *